US007544311B2

(12) United States Patent
Chen et al.

(10) Patent No.: US 7,544,311 B2
(45) Date of Patent: Jun. 9, 2009

(54) POSITIVE TEMPERATURE COEFFICIENT POLYMER COMPOSITION AND CIRCUIT PROTECTION DEVICE MADE THEREFROM

(75) Inventors: Jack Jih-Sang Chen, Hsin-Chuang (TW); Chi-Hao Gu, Hsin-Chuang (TW)

(73) Assignee: Fuzetec Technology Co., Ltd., Hsin-Chuang, Taipei Hsien (TW)

( * ) Notice: Subject to any disclaimer, the term of this patent is extended or adjusted under 35 U.S.C. 154(b) by 320 days.

(21) Appl. No.: 11/101,032

(22) Filed: Apr. 6, 2005

(65) Prior Publication Data

US 2006/0226397 A1 Oct. 12, 2006

(51) Int. Cl.
*H01B 1/00* (2006.01)

(52) U.S. Cl. ..... 252/500; 252/512; 252/513; 219/505; 524/495; 525/240

(58) Field of Classification Search ..... 252/500, 252/512, 513; 524/495; 219/505; 338/22 R; 525/240

See application file for complete search history.

(56) References Cited

U.S. PATENT DOCUMENTS 4,576,993 A * 3/1986 Tamplin et al. ..... 525/240
5,378,407 A * 1/1995 Chandler et al. ..... 252/513
5,691,689 A * 11/1997 Smith et al. ..... 338/22 R
5,928,547 A * 7/1999 Shea et al. ..... 219/505
6,238,598 B1 * 5/2001 Chen ..... 252/512
6,359,053 B1 * 3/2002 Chen ..... 524/495
2004/0222406 A1 * 11/2004 Chen et al. ..... 252/500

FOREIGN PATENT DOCUMENTS

JP 2003-318006 * 11/2003

* cited by examiner

*Primary Examiner*—Mark Kopec
*Assistant Examiner*—Khanh Tuan Nguyen
(74) *Attorney, Agent, or Firm*—Christensen O'Connor Johnson Kindness PLLC

(57) ABSTRACT

A PTC polymer composition contains: (a) a non-elastomeric polymer mixture in an amount from 20 wt % to 80 wt % based on the weight of the polymer composition; (b) a conductive particulate material in an amount from 20 wt % to 60 wt % based on the weight of the polymer composition; (c) a voltage resistance-enhancing agent that contains particulate metal oxide material in an amount from 1 wt % to 30 wt % based on the weight of the polymer composition; and (d) a polymer stabilizer that contains a thermoplastic elastomer in an amount from 1 wt % to 30 wt % based on the weight of the polymer composition.

28 Claims, No Drawings

POSITIVE TEMPERATURE COEFFICIENT POLYMER COMPOSITION AND CIRCUIT PROTECTION DEVICE MADE THEREFROM

BACKGROUND OF THE INVENTION

1. Field of the Invention

This invention relates to a positive temperature coefficient (PTC) polymer composition and a circuit protection device made therefrom, more particularly to a PTC polymer composition containing a voltage resistance-enhancing agent and a polymer stabilizer.

2. Description of the Related Art

U.S. Pat. No. 6,238,598 discloses a PTC polymer composition that comprises a crystalline grafted polymer and a crystalline non-grafted polymer. Addition of the grafted polymer in the polymer composition improves the properties, such as peel strength, low contact resistance, low initial resistance, high trip current, and high peak volume resistance, of a PTC component made therefrom.

U.S. Pat. No. 6,359,053 discloses a PTC polymer composition that comprises a crystalline grafted polymer, a crystalline non-grafted polymer, and an ionomer of an ionic copolymer of the crystalline non-grafted polymer and an ionized unsaturated carboxylic acid. Addition of the ionic copolymer in the polymer composition improves mechanical properties, such as toughness, good low temperature toughness, high impact strength, and high elasticity, of a PTC component made therefrom.

Circuit protection devices, such as a circuit protection device, made from the aforesaid conventional PTC polymer compositions normally have a low voltage resistance. For instance, a circuit protection device made from the a fore said conventional PTC polymer compositions, which has a volume resistivity of less than 50 ohm-cm and which is used in applications that operate at about 10-40 volts, normally has a maximum voltage rating at about 60 volts, i.e., the circuit protection device will likely break or burn out when the applied voltage reaches the maximum voltage resistance. Therefore, there is a need to increase the voltage resistance of the aforesaid conventional PTC polymer compositions without sacrificing other properties of the circuit protection device.

Commercial polymeric PTC heater devices are made from polymer compositions that have a volume resistivity greater than 50 ohm-cm and often in a range of from 200-1000 ohm-cm. Such heater devices normally operate at a high voltage condition, e.g., 110-240 VAC or higher (above 600VAC) . As such, such polymer compositions have a relatively high voltage resistance and have no need for further enhancement required by those for the circuit protection device.

In co-pending U.S. patent application Ser. No. 10/435,065 filed on May 8, 2003, the applicant disclosed a PTC polymer composition that comprises a polymer mixture, a conductive particulate material, and a voltage resistance-enhancing agent which comprises a particulate metal oxide material. Although, by virtue of the voltage resistance-enhancing agent, the voltage resistance of the PTC polymer composition can be significantly increased, there is still a need to improve the life cycle of the same for high voltage applications.

The entire disclosures of the aforementioned patents are incorporated herein by reference.

SUMMARY OF THE INVENTION

Therefore, the object of the present invention is to provide a PTC polymer composition with a polymer stabilizer that is capable of providing an improved life cycle.

Another object of this invention is to provide a circuit protection device made from the polymer composition of the present invention.

According to the present invention, there is provided a PTC polymer composition that comprises: (a) a non-elastomeric polymer mixture in an amount from 20 wt % to 80 wt % based on the weight of the polymer composition; (b) a conductive particulate material in an amount from 20 wt % to 60 wt % based on the weight of the polymer composition; (c) a voltage resistance-enhancing agent that comprises a particulate metal oxide material in an amount from 1 wt % to 30 wt % based on the weight of the polymer composition; and (d) a polymer stabilizer that comprises a thermoplastic elastomer in an amount from 1 wt % to 30 wt % based on the weight of the polymer composition.

DETAILED DESCRIPTION OF THE PREFERRED EMBODIMENT

The PTC polymer composition of this invention, which is particularly useful in the manufacture of a PTC circuit protection device, such as a PTC circuit protection device with a volume resistivity at 23° C. of less than 50 ohm-cm, comprises: (a) a non-elastomeric polymer mixture in an amount from 20 wt % to 80 wt % based on the weight of the polymer composition; (b) a conductive particulate material in an amount from 20 wt % to 60 wt % based on the weight of the polymer composition; (c) a voltage resistance-enhancing agent that comprises a particulate metal oxide material in an amount from 1 wt % to 30 wt % based on the weight of the polymer composition; and (d) a polymer stabilizer that comprises a thermoplastic elastomer in an amount from 1 wt % to 30 wt % based on the weight of the polymer composition.

Preferably, the non-elastomeric polymer mixture contains (i) a crystalline grafted polymer, (ii) a crystalline non-grafted polymer, and optionally (iii) an ionic copolymer of the crystalline non-grafted polymer and an ionized unsaturated carboxylic acid. It is noted that the combination of the polymer mixture and the polymer stabilizer in the polymer composition of this invention unexpectedly provides a synergestic effect in enhancing the life cycle of a PTC circuit protection device made therefrom as compared to those made from compositions containing the polymer stabilizer and polymers that solely include the non-grafted polymers.

The crystalline grafted polymer is selected from a group consisting of grafted polyolefin, grafted polyolefin derivatives, and grafted copolymers of polyolefin and polyolefin derivatives. The grafted polymer is grafted by a polar group selected from a group consisting of carboxylic acids and derivatives thereof.

The crystalline non-grafted polymer is selected from a group consisting of non-grafted polyolefin, non-grafted polyolefin derivatives, and non-grafted copolymers of polyolefin and polyolefin derivatives. The non-grafted polymer has a melting point substantially the same as that of the grafted polymer.

The voltage resistance-enhancing agent comprises a particulate metal oxide material which is dispersed in the polymer mixture for increasing the voltage resistance (i.e., the resistance to damage attributed by an applied voltage) of the polymer composition. For the sake of clarity, a maximum voltage resistance of a circuit protection device is defined hereinafter as a value of voltage under which the circuit protection device breaks or burns out.

Preferably, the grafted polyolefin is selected from the group consisting of grafted high density polyethylene (HDPE), grafted low density polyethylene (LDPE), grafted linear low density polyethylene (LLDPE), grafted medium density polyethylene (MDPE), and grafted polypropylene (PP). More preferably, the grafted polyolefin is grafted HDPE. Preferably, the grafted copolymer of polyolefin and polyolefin derivatives is selected from a group consisting of grafted ethylene vinyl acetate (EVA) copolymer, grafted ethylene butyl acrylate (EBA) copolymer, grafted ethylene acrylic acid (EAA) copolymer, grafted ethylene methyl acrylic acid (EMAA) copolymer, and grafted ethylene methyl acrylic (EMA) copolymer.

Preferably, the non-grafted polyolefin is selected from the group consisting of non-grafted HDPE, non-grafted LDPE, non-grafted LLDPE, non-grafted MDPE, and non-grafted PP. More preferably, the crystalline non-grafted polyolefin is non-grafted HDPE. Preferably, the non-grafted copolymer of the polyolefin and the polyolefin derivatives is selected from a group consisting of non-grafted EVA, non-grafted EBA, non-grafted EAA, non-grafted EMAA, and non-grafted EMA.

The conductive particulate material is selected from a group consisting of carbon black, graphite, carbon fiber and metal powder particulate.

The unsaturated carboxylic acid included in the ionomer is selected from a group consisting of maleic anhydride, acrylic acid and acetic acid. Preferably, the unsaturated carboxylic acid is acrylic acid.

The thermoplastic elastomer is preferably selected from the group consisting of fluoropolymer elastomers, olefinic elastomers, polyamide elastomers, polyester elastomers, polyurethane elastomers, polyurethane/polycarbonate elastomers, styrenic elastomers, and vinyl elastomers, and is more preferably selected from the olefinic elastomers.

The olefinic elastomer may include hard and soft segments such that the hard segment of the olefinic elastomer is selected from the group consisting of polypropylene, polyethylene, and the like, while the soft segment of the olefinic elastomer is selected from the group consisting of polybutadiene, polyisoprene, polyoctene, hydrogenated polybutadiene, hydrogenated polyisoprene, hydrogenated polyoctene, ethylene-propylene diene monomer (EPDM), and the like.

In a preferred embodiment, the olefinic elastomer is ethylene-octene copolymer.

The merits of the polymer composition of this invention will become apparent with reference to the following Examples.

EXAMPLES 1-7 AND COMPARATIVE EXAMPLE 1

Table 1 shows different polymer compositions and life cycle test results for Examples 1-7 (with a thermoplastic elastomer) and Comparative Example 1 (without a thermoplastic elastomer). Test specimens prepared from the polymer compositions listed in Table 1 were subjected to life cycle test bypassing a current therethrough under a high voltage. Each test specimen was prepared by compounding and thermal molding the polymer composition to form a PTC element sheet, followed by attachment of two copper foils to two opposite sides of the PTC sheet for forming electrodes on the PTC sheet.

TABLE 1

| | Polymer Composition | | | | | | | |
|---|---|---|---|---|---|---|---|---|
| | HDPE wt % | Grafted PE wt % | Carbon Black wt % | Aluminum Oxide wt % | Elastomer# wt % | Resistance, Ohm | Life cycles | Test condition |
| Example 1 | 42 | 4 | 35 | 17 | 2 | 3.93 | 3.4 | 3A/600Vac |
| Example 2 | 40 | 4 | 35 | 17 | 4 | 3.47 | 7.8 | 3A/600Vac |
| Example 3 | 38 | 4 | 35 | 17 | 6 | 3.94 | 6.6 | 3A/600Vac |
| Example 4 | 36 | 4 | 35 | 17 | 8 | 4.32 | 6.0 | 3A/600Vac |
| Example 5 | 34 | 4 | 35 | 17 | 10 | 4.91 | 6.4 | 3A/600Vac |
| Example 6 | 43 | 1 | 33 | 17 | 4 | 3.65 | 4 | 1.5A/600Vac |
| Example 7 | 33.5 | 10 | 35.5 | 17 | 4 | 4.24 | 2 | 1.5A/600Vac |
| Comparative Example 1 | 44 | 4 | 35 | 17 | 0 | 5.44 | 1.4 | 3A/600Vac |

#The elastomer used in each of the Examples and the Comparative Examples was Engage ®, a product of DuPont Dow Elastomers, that comprises mainly ethylene-octene copolymer.

The metal oxide material of the voltage resistance-enhancing agent is preferably selected from a group consisting of zinc oxide, aluminum oxide, and magnesium oxide.

The polymer composition of this invention preferably contains from 0.5 to 10 wt % of the grafted polymer, 30 to 60 wt % of the non-grafted polymer, from 5 to 30 wt % of the voltage resistance-enhancing agent, and from 2 to 10 wt % of the thermoplastic elastomer, and more preferably contains from 3 to 5 wt % of the grafted polymer, 35 to 50 wt % of the non-grafted polymer, from 10 to 20 wt % of the voltage resistance-enhancing agent, and from 3 to 5 wt % of the thermoplastic elastomer.

The test results show that the life cycle of PTC sheets can be improved significantly when an elastomer is blended with the polymer mixture.

EXAMPLES 8-12 and COMPARATIVE EXAMPLE 2

Table 2 shows different polymer compositions and life cycle test results for Examples 8-12 (with an elastomer and a particulate metal oxide material) and Comparative Example 2 (with an elastomer but without a particulate metal oxide material). Test specimens prepared from the polymer compositions listed in Table 2 were subjected to life cycle test bypassing a current therethrough under a high voltage. Each test specimen was prepared by compounding and thermal molding the polymer composition to form a PTC element sheet, followed by attachment of two copper foils to two opposite sides of the PTC sheet for forming electrodes on the PTC sheet.

TABLE 2

| | Polymer Composition | | | | | | | |
|---|---|---|---|---|---|---|---|---|
| | HDPE wt % | Grafted PE wt % | Carbon Black wt % | Aluminum Oxide wt % | Elastomer# wt % | Resistance, Ohm | Life cycles | Test condition |
| Example 8 | 47 | 4 | 40 | 5 | 4 | 5.48 | 1.6 | 3A/600Vac |
| Example 9 | 45 | 4 | 37 | 10 | 4 | 4.87 | 3.8 | 3A/600Vac |
| Example 10 | 42 | 4 | 35 | 15 | 4 | 5.05 | 7.0 | 3A/600Vac |
| Example 11 | 39 | 4 | 33 | 20 | 4 | 5.27 | 5.8 | 3A/600Vac |
| Example 12 | 31 | 4 | 31 | 30 | 4 | 4.85 | 3.0 | 3A/600Vac |
| Comparative Example 2 | 50 | 4 | 42 | 0 | 4 | 3.07 | 0 | 3A/600Vac |

#The elastomer used in each of the Examples and the Comparative Examples was Engage ®.

The test results show that the life cycle of PTC sheets can be improved significantly when a particulate metal oxide material is blended with the polymer mixture and the elastomer.

COMPARATIVE EXAMPLES 3-5

Table 3 shows polymer compositions and life cycle test results for Comparative Examples 3-5 (without the grafted polymer in the polymer mixture). Test specimens prepared from the polymer compositions listed in Table 3 were subjected to life cycle test by passing a current therethrough under a high voltage. Each test specimen was prepared by compounding and thermal molding the polymer composition to form a PTC element sheet, followed by attachment of two copper foils to two opposite sides of the PTC sheet for forming electrodes on the PTC sheet.

TABLE 3

| | Polymer Composition | | | | | | | |
|---|---|---|---|---|---|---|---|---|
| | HDPE wt % | Grafted PE wt % | Carbon Black wt % | Aluminum Oxide wt % | Elastomer# wt % | Resistance, Ohm | Life cycles | Test condition |
| Comparative Example 3 | 46 | 0 | 33 | 17 | 4 | 3.52 | 0 | 1.5A/600Vac |
| Comparative Example 4 | 38 | 0 | 28 | 30 | 4 | 3.73 | 0 | 1.5A/600Vac |
| Comparative Example 5 | 58 | 0 | 33 | 5 | 4 | 5.45 | 0 | 1.5A/600Vac |

#The elastomer used in the Comparative Examples was Engage ®.

With the invention thus explained, it is apparent that various modifications and variations can be made without departing from the spirit of the present invention. It is therefore intended that the invention be limited only as recited in the appended claims.

We claim:

1. A positive temperature coefficient polymer composition comprising:

(a) a non-elastomeric polymer mixture in an amount from 35 wt % to 49 wt % based on the weight of said polymer composition, wherein the mixture comprises 0.5 wt % to 10 wt % of a crystalline grafted polymer;

(b) a conductive particulate material in an amount from 31 wt % to 37 wt % based on the weight of said polymer composition;

(c) a voltage resistance-enhancing agent that comprises a particulate metal oxide material in an amount from 10 wt % to 30 wt % based on the weight of said polymer composition; and (d) a polymer stabilizer that comprises a thermoplastic elastomer in an amount from 4 wt % to 10 wt % based on the weight of said polymer composition.

2. The positive temperature coefficient polymer composition of claim 1, wherein said non-elastomeric polymer mixture comprises a polymer mixture containing (i) a crystalline grafted polymer selected from a group consisting of grafted polyolefin, grafted polyolefin derivatives, and grafted copolymers of polyolefin and polyolefin derivatives, said grafted polymer being grafted by a polar group selected from a group consisting of carboxylic acids and derivatives thereof, and (ii) a crystalline non-grafted polymer selected from a group consisting of non-grafted polyolefin, non-grafted polyolefin derivatives, and non-grafted copolymers of polyolefin and polyolefin derivatives, said non-grafted polymer having a melting point substantially the same as that of said grafted polymer.

3. The positive temperature coefficient polymer composition of claim 2, wherein said grafted polyolefin is selected from a group consisting of grafted HDPE, grafted LDPE, grafted LLDPE, grafted MDPE, and grafted PP.

4. The positive temperature coefficient polymer composition of claim 2, wherein said non-grafted polyolefin is selected from a group consisting of non-grafted HDPE, non-grafted LDPE, non-grafted LLDPE, non-grafted MDPE, and non-grafted PP.

5. The positive temperature coefficient polymer composition of claim 2, wherein said conductive particulate material is selected from a group consisting of carbon black, graphite, carbon fiber, and metal powder particulate.

6. The positive temperature coefficient polymer composition of claim 2, wherein said metal oxide material is selected from a group consisting of zinc oxide, aluminum oxide, and magnesium oxide.

7. The positive temperature coefficient polymer composition of claim 2, wherein said polymer mixture further contains an ionic copolymer of said crystalline non-grafted polymer and an ionized unsaturated carboxylic acid.

8. The positive temperature coefficient polymer composition of claim 7, wherein said unsaturated carboxylic acid is selected from a group consisting of maleic anhydride, acrylic acid and acetic acid.

9. The positive temperature coefficient polymer composition of claim 2, wherein said grafted copolymer of polyolefin and polyolefin derivatives is selected from a group consisting of grafted ethylene vinyl acetate (EVA) copolymer, grafted ethylene butyl acrylate (EBA) copolymer, grafted ethylene acrylic acid (EAA) copolymer, grafted ethylene methyl acrylic acid (EMAA) copolymer, and grafted ethylene methyl acrylic (EMA) copolymer.

10. The positive temperature coefficient polymer composition of claim 2, wherein said non-grafted copolymer of polyolefin and polyolefin derivatives is selected from a group consisting of non-grafted EVA, non-grafted EBA, non-grafted EAA, non-grafted EMAA, and non-grafted EMA.

11. The positive temperature coefficient polymer composition of claim 1, wherein said thermoplastic elastomer is selected from the group consisting of fluoropolymer elastomers, olefinic elastomers, polyamide elastomers, polyester elastomers, polyurethane elastomers, polyurethane/polycarbonate elastomers, styrenic elastomers, and vinyl elastomers.

12. The positive temperature coefficient polymer composition of claim 11, wherein said thermoplastic elastomer is an olefinic elastomer.

13. The positive temperature coefficient polymer composition of claim 12, wherein said olefinic elastomer includes hard and soft segments, the hard segment of said olefinic elastomer being selected from the group consisting of polypropylene and polyethylene, while the soft segment of said olefinic elastomer being selected from the group consisting of polybutadiene, polyisoprene, polyoctene, hydrogenated polybutadiene, hydrogenated polyisoprene, hydrogenated polyoctene, and EPDM.

14. The positive temperature coefficient polymer composition of claim 12, wherein said polyolefin elastomer is ethylene-octene copolymer.

15. A circuit protective device comprising:

a PTC element having a volume resistivity at 23° C. of less than 50 ohm-cm and containing a polymer composition that comprises (a) a non-elastomeric polymer mixture in an amount from 35 wt % to 49 wt % based on the weight of said polymer composition, wherein the mixture comprises 0.5 wt % to 10 wt % of a crystalline grafted polymer, (b) a conductive particulate material in an amount from 31 wt % to 37 wt % based on the weight of said polymer composition, (c) a voltage resistance-enhancing agent that comprises a particulate metal oxide material in an amount from 10 wt % to 30 wt % based on the weight of said polymer composition, and (d) a polymer stabilizer that comprises a thermoplastic elastomer in an amount from 4 wt % to 10 wt % based on the weight of said polymer composition; and two electrodes connected respectively to two opposite sides of said PTC element.

16. The circuit protection device of claim 15, wherein said non-elastomeric polymer mixture comprises a polymer mixture containing (i) a crystalline grafted polymer selected from a group consisting of grafted polyolefin, grafted polyolefin derivatives, and grafted copolymers of polyolefin and polyolefin derivatives, said grafted polymer being grafted by a polar group selected from a group consisting of carboxylic acids and derivatives thereof, and (ii) a crystalline non-grafted polymer selected from a group consisting of non-grafted polyolefin, non-grafted polyolefin derivatives, and non-grafted copolymers of polyolefin and polyolefin derivatives, said non-grafted polymer having a melting point substantially the same as that of said grafted polymer.

17. The circuit protection device of claim 16, wherein said grafted polyolefin is selected from a group consisting of grafted HDPE, grafted LDPE, grafted LLDPE, grafted MDPE, and grafted PP.

18. The circuit protection device of claim 16, wherein said non-grafted polyolefin is selected from a group consisting of non-grafted HDPE, non-grafted LDPE, non-grafted LLDPE, non-grafted MDPE, and non-grafted PP.

19. The circuit protection device of claim 16, wherein said conductive particulate material is selected from a group consisting of carbon black, graphite, carbon fiber, and metal powder particulate.

20. The circuit protection device of claim 16, wherein said metal oxide material is selected from a group consisting of zinc oxide, aluminum oxide, and magnesium oxide.

21. The circuit protection device of claim 16, wherein said polymer mixture further contains an ionic copolymer of said crystalline non-grafted polymer and an ionized unsaturated carboxylic acid.

22. The circuit protection device of claim 21, wherein said unsaturated carboxylic acid is selected from a group consisting of maleic anhydride, acrylic acid and acetic acid.

23. The circuit protection device of claim 16, wherein said grafted copolymer of polyolefin and polyolefin derivatives is selected from a group consisting of grafted ethylene vinyl acetate (EVA) copolymer, grafted ethylene butyl acrylate (EBA) copolymer, grafted ethylene acrylic acid (EAA) copolymer, grafted ethylene methyl acrylic acid (EMAA) copolymer, and grafted ethylene methyl acrylic (EMA) copolymer.

24. The circuit protection device of claim 16, wherein said non-grafted copolymer of polyolefin and polyolefin derivatives is selected from a group consisting of non-grafted EVA, non-grafted EBA, non-grafted EAA, non-grafted EMAA, and non-grafted EMA.

25. The circuit protection device of claim 15, wherein said thermoplastic elastomer is selected from the group consisting of fluoropolymer elastomers, olefinic elastomers, polyamide elastomers, polyester elastomers, polyurethane elastomers, polyurethane/polycarbonate elastomers, styrenic elastomers, and vinyl elastomers.

26. The circuit protection device of claim 25, wherein said thermoplastic elastomer is an olefinic elastomer.

27. The circuit protection device of claim 26, wherein said olefinic elastomer has hard and soft segments, the hard segment of said olefinic elastomer being selected from the group consisting of polypropylene and polyethylene, while the soft segment of said olefinic elastomer being selected from the group consisting of polybutadiene, polyisoprene, polyoctene, hydrogenated polybutadiene, hydrogenated polyisoprene, hydrogenated polyoctene, and EPDM.

28. The circuit protection device of claim 26, wherein said polyolefin elastomer is ethylene-octene copolymer.

* * * * *